US005656580A

United States Patent [19]

Carrie et al.

[11] Patent Number: 5,656,580

[45] Date of Patent: Aug. 12, 1997

[54] ACIDIC CLEANING COMPOSITIONS SELF-THICKENED BY A MIXTURE OF CATIONIC AND NONIONIC SURFACTANTS

[75] Inventors: Michel Jean Carrie, Strombeek-Bever; Axel Koenig, Wemmel; Eddy Vos, Linden, all of Belgium

[73] Assignee: The Procter & Gamble Company, Cincinnati, Ohio

[21] Appl. No.: 446,758

[22] PCT Filed: Dec. 2, 1993

[86] PCT No.: PCT/US93/11680

§ 371 Date: Jun. 2, 1995

§ 102(e) Date: Jun. 2, 1995

[87] PCT Pub. No.: WO94/13769

PCT Pub. Date: Jun. 23, 1994

[30] Foreign Application Priority Data

| | | | |
|---|---|---|---|
| Dec. 4, 1992 | [EP] | European Pat. Off. | 92870195 |
| Jun. 25, 1993 | [EP] | European Pat. Off. | 93870120 |

[51] Int. Cl.[6] ..... C11D 1/835; C11D 1/62; C11D 17/00

[52] U.S. Cl. ..... 510/362; 510/191; 510/238; 510/384; 510/403; 510/404; 510/423; 510/433; 510/434; 510/477; 510/504; 510/506

[58] Field of Search ..... 252/142, 143, 252/547, 174.19, 173, DIG. 14; 510/191, 238, 362, 384, 403, 404, 423, 433, 434, 477, 504, 506

[56] References Cited

U.S. PATENT DOCUMENTS

| | | | |
|---|---|---|---|
| 3,915,633 | 10/1975 | Ramachandran | 8/137 |
| 3,954,630 | 5/1976 | Ramachandran | 442/93 |
| 4,666,622 | 5/1987 | Martin et al. | 252/186.22 |
| 4,891,150 | 1/1990 | Gross et al. | 510/191 |
| 5,008,030 | 4/1991 | Cook et al. | 510/384 |
| 5,100,660 | 3/1992 | Hawe et al. | 424/78.35 |

FOREIGN PATENT DOCUMENTS

| | | |
|---|---|---|
| 0 518 401 | 12/1992 | European Pat. Off. . |
| 4-332799 | 11/1992 | Japan . |
| 43-32799 | 11/1992 | Japan . |
| 1 476 840 | 6/1977 | United Kingdom . |

OTHER PUBLICATIONS

Chemical Abstracts accession No. 99:72644e published Sep. 5, 1983 (for AU 528,029); see also attached CA Online printouts.

*Primary Examiner*—Ardith Hertzog
*Attorney, Agent, or Firm*—Robert B. Aylor; T. David Reed

[57] ABSTRACT

Acidic cleaning compositions which are self-thickened by a thickening system comprising a mixture of a quaternary ammonium compound cationic surfactant and a nonionic surfactant. The compositions are for hard surface cleaning and are specifically suitable for the removal of limescale.

10 Claims, No Drawings

ACIDIC CLEANING COMPOSITIONS SELF-THICKENED BY A MIXTURE OF CATIONIC AND NONIONIC SURFACTANTS

TECHNICAL FIELD

The present invention relates to cleaning compositions for hard surfaces. The compositions of the present invention are designed for optimum performance in removing limescale and are thickened without the use of a thickener compound.

BACKGROUND OF THE INVENTION

Compositions for cleaning hard surfaces, including compositions for removing limescale, are well known in the art. Such compositions, which are characterized mainly by a strong acidity, are disclosed for instance in EP 496 188.

Limescale is mainly found in such places as sinks, toilet bowls and bathtubs, i.e. vertical surfaces. Therefore, it is desirable to give some viscosity to compositions for removing limescale so as to prevent said compositions from running down said vertical surfaces. Indeed thick compositions cling to vertical surfaces, thus they have more time to act on vertical surfaces before they run down said surfaces. It is however undesirable to use thickener compounds in such compositions for various reasons. For instance, thickener compounds may significantly raise formula costs. Also, thickeners may create issues relating to processing and product stability, especially in extreme acidic conditions. Furthermore, thickeners may affect the limescale removing performance of the composition. Finally, thickeners do not contribute to the cleaning performance of the composition.

It is therefore desirable to provide limescale removing compositions in the form of self-thickened systems. Self-thickened systems have been disclosed for instance in co-pending EP 92201412.1. In these systems, the thickening effect is obtained by the combination of an anionic surfactant, a nonionic surfactant and an electrolyte. It has however been found that such systems are not optimum for limescale removing compositions. Indeed, this approach does not seem to provide viscosity in a strongly acidic system unless very high levels of ingredients are used, and strong negatives have been observed on limescale removal. Furthermore, the stability of anionic surfactants may be problematic in such strongly acidic conditions.

It has now been found that a stable self-thickened effect could be obtained in an acidic medium, without compromising on the limescale removing efficiency of the composition by combining a quaternary ammonium salt surfactant with a nonionic surfactant. This solution has the additional advantage that the thickening system also fulfills a detergent function.

Additionally it has been found that the compositions according to the present invention have the advantage that the use of the quaternary ammonium salts cationic surfactants described hereinafter in combination with an acid provides significant disinfectancy benefits. This advantage is particularly useful in a composition which is meant to be used primarily on bathroom and kitchen surfaces.

GB 2 071 688 teaches that quaternary ammonium salts can be used to thicken an acidic solution, provided they are combined with an amine or amine oxide. In the '688 patent, nonionic surfactants are presented as an alternative to the quaternary ammonium salts.

EP 188 205 teaches that quaternary ammonium salts can be used to thicken an acidic solution, provided they are combined with a strong mineral acid.

SUMMARY OF THE INVENTION

The compositions according to the present invention are aqueous compositions comprising an acid whereby the pH as is of said compositions is of from 0.1 to 4.5, said compositions further comprising a thickening system whereby said compositions are stable and have a viscosity of from 10 to 700 cps at 60 rpm shear rate at 20° C. , characterized in that said thickening system comprises from 0.5% to 15% by weight of the total composition of a mixture of a nonionic surfactant with a cationic surfactant according to the formula $R_1R_2R_3R_4N^+ X^-$, wherein X is a counteranion, $R_1$ is a $C_{12-20}$ hydrocarbon chain and $R_2$, $R_3$ and $R_4$ are independently selected from H or $C_{1-4}$ hydrocarbon chains.

DETAILED DESCRIPTION OF THE INVENTION

The compositions of the present invention are designed for removing limescale or soils comprising limescale as a main component. Thus they comprise, as a first essential ingredient, an organic or inorganic acid, or mixtures thereof. Appropriate acids for use herein are disclosed for instance in EP 411 708, EP 496 188, GB 2 106 927, EP 200 776, and EP 336 878. Although a wide variety of acids are suitable for use herein from a pure performance viewpoint, it is preferred to avoid the use of strong inorganic acids such as phosphoric acid or HCl, for environmental reasons and for surface safety. Preferred for use herein are organic acids or mixtures thereof. Particularly preferred for use herein are weak organic acids, and particularly preferred is maleic acid which is particularly appealing from both in terms of environmental compatibility and performance. The compositions according to the present invention comprise from 0.1% to 45% by weight of the total composition of an acid or mixtures thereof, preferably from 4% to 25%. Thus, the compositions according to the present have a pH as is of from 0.1 to 4.5, preferably 0.5 to 2.0, most preferably about 1.0.

As the second essential ingredient, the compositions according to the present invention comprise a thickening system which consists of a mixture of certain cationic surfactants with nonionic surfactants. In a highly preferred embodiment, the compositions according to the present invention are free of a thickener compound, i.e. a compound which has the sole purpose of thickening the composition.

The suitable cationic surfactants for use herein are according to the formula $R_1R_2R_3R_4N^+ X^-$, wherein X is a counteranion, $R_1$ is a $C_{12-20}$ hydrocarbon chain and $R_2$, $R_3$ and $R_4$ are independently selected from H or $C_{1-4}$ hydrocarbon chains. In a preferred embodiment of the invention, $R_1$ is a $C_{14-18}$ hydrocarbon chain, most preferably $C_{16}$ or $C_{18}$, and $R_1$, $R_2$ and $R_3$ are all three methyl, and X is halogen, preferably bromide or chloride, most preferably bromide. It is also possible to use mixtures of such cationic surfactants without departing from the spirit of the present invention.

Suitable nonionic surfactants for use herein include compounds having the general formula $RA(CH_2CH_2CH_2O)_m(CH_2CH_2O)_nH$, wherein R represents a hydrophobic moiety, A represents a group carrying a reactive hydrogen atom, m represents the average number of propylene oxide moieties and n represents the average number of ethylene oxide moieties. These compounds are typically obtained by condensing ethylene oxide and/or propylene oxide with a hydrocarbon having a reactive hydrogen, e.g. a hydroxyl, carboxyl, or amido group, in the presence of an acidic or basic catalyst. In the present invention, the hydrophobic moiety of the nonionic compound can be a primary or secondary, straight or branched alcohol having from about 8 to about 24 carbon atoms, preferably 12 to 18, m is 0 and n varies from 1 to 15. Such suitable surfactants for use herein are commercially available, for instance from Shell under the trade name Dobanol®, or from BASF under the trade name Lutensol®. It is of course possible to use mixtures of different nonionic surfactants without departing from the spirit of the present invention.

The compositions according to the present invention comprise from 0.5% to 15% by weight of the total composition of said thickening system, preferably from 1% to 8%. The compositions according to the present invention consequently have a viscosity in the range of from 10 cps to 700 cps at 60 RPM at 20° C., preferably from 20 cps to 200 cps, most preferably 30 cps to 60 cps.

The selection of the most appropriate thickening system depends on such factors as the target viscosity, the acid concentration and the limescale removal performance target. In mere terms of viscosity, it has been found that using straight alkyl chains in both the cationic and the nonionic surfactants provides the best viscosity build up. In the system according to the present invention the combination of the cationic surfactant with the nonionic surfactant allows to build viscosity in an aqueous solution of an acid, even a weak organic acid, whereby this system is stable and the limescale removal performance of said viscosified solution is substantially preserved.

An appropriate way to proceed in determining a suitable thickening system for a given composition is to start by defining the desired limescale removing performance for said composition, i.e. the type and concentration of acid, and to prepare a corresponding aqueous solution of said acid. Then various combinations of cationic and nonionic surfactants can be tried in order to obtain the target viscosity as a stable composition. By stable, it is meant herein that the composition undergoes no phase separation during a substantial period of time in a temperature range of from 0° C. to 50° C. The most appropriate system can thus be selected by trial and error.

The compositions according to the present invention may further comprise such optional ingredients as solvents, bleaches, bactericides, perfumes, dyes and the like, provided they are compatible in the acidic medium of the compositions according to the present invention.

The compositions according to the present invention are further illustrated by the following examples.

EXAMPLES

The following compositions are prepared by mixing the listed ingredients in the listed proportions.

| | I | II | III | IV | V |
|---|---|---|---|---|---|
| CTAB | 3.2 | 4.2 | — | — | — |
| Cetrimide | — | — | 4.2 | — | — |
| STAB | — | — | — | 4.2 | 1.0 |
| Maleic acid | 8.0 | 8.6 | 8.6 | 8.6 | 8.0 |
| Dobanol 23-3® | 1.6 | 2.9 | 2.1 | 0.8 | 0.5 |
| pH as is | 1.0 | 0.9 | 0.9 | 0.9 | 0.9 |
| Viscosity (cps at 60 rpm) | 47 | 29 | 70 | 270 | 20 |

-continued

| | VI | VII | VIII | IX |
|---|---|---|---|---|
| CTAB | 3.0 | 4.2 | 4.2 | 5.0 |
| Maleic acid | 10.0 | 12.6 | 4.2 | 10.0 |
| Dobanol 23-3® | 1.6 | 3.4 | 1.3 | 1.6 |
| Lutensol ON 30® | 0.4 | — | — | 0.4 |
| pH as is | 0.9 | 0.8 | 1.1 | 1.0 |
| Viscosity (cps at 60 rpm) | 30 | 54 | 200 | 41 |

In the above examples:

CTAB stands for a C16 trimethyl ammonium bromide; Cetrimide stands for C14 trimethyl ammonium bromide; STAB stands for C18 trimethyl ammonium bromide; Dobanol®23-3 is a C12–13 ethoxylated alcohol with an average degree of ethoxylation of 3, available from Shell; Lutensol® ON 30 is a C8–C12 ethoxylated alcohol with an average degree of ethoxylation of 3.

All the compositions according to the examples above were stable during 10 days at 50° C.

What is claimed is:

1. An aqueous composition comprising an acid whereby the pH of said composition is from 0.1 to 4.5, said composition further comprising a thickening system whereby said composition is stable and has a viscosity of from 10 to 700 cps at 60 rpm shear rate at 20° C., characterized in that said thickening system comprises from 0.5% to 8% by weight of the total composition of a mixture of a nonionic surfactant with a cationic surfactant according to the formula $R_1R_2R_3R_4N^+ X^-$, wherein X is a counterion, $R_1$ is a $C_{12-20}$ hydrocarbon chain and $R_2$, $R_3$, and $R_4$ are independently selected from the group consisting of H and $C_{1-4}$ hydrocarbon chains, the weight ratio of said cationic surfactant to said nonionic surfactant being from 1.235:1 to 5.25:1.

2. A composition according to claim 1 which comprises from 1% to 8% of said mixture of said nonionic and said cationic surfactant.

3. A composition according to claim 1, wherein said acid is an organic acid.

4. A composition according to claim 3, wherein said acid is maleic acid.

5. A composition according to claim 1 which comprises from 0.1% to 45% by weight of the total composition of said acid.

6. A composition according to claim 5 which comprises from about 4% by weight to about 25% by weight of said acid.

7. A composition according to claim 1 wherein said nonionic surfactant is an ethoxylated alcohol having from about 8 to about 24 carbon atoms, and an average degree of ethoxylation of from 1 to 15.

8. A composition according to claim 7 wherein said ethoxylated alcohol has from about 12 to about 18 carbon atoms.

9. A composition according to claim 1 wherein in said cationic surfactant $R_1$ is a $C_{14-18}$ hydrocarbon chain and $R_1$, $R_2$ and $R_3$ are all three methyl, and X is bromide or chloride.

10. A composition according to claim 9 wherein said cationic surfactant $R_1$ is a $C_{16}$ or $C_{18}$ hydrocarbon chain.

* * * * *